US007475942B2

(12) United States Patent
Boyle et al.

(10) Patent No.: US 7,475,942 B2
(45) Date of Patent: Jan. 13, 2009

(54) RECONFIGURABLE SWING/GLIDER DEVICE

(75) Inventors: Brendan John Boyle, Palo Alto, CA (US); Alexander Coriano, Brisbane, CA (US); James Adam Skaates, San Francisco, CA (US); Michelle Sau Kuen Lee, San Francisco, CA (US); Eric Kenji Toyofuku, Palo Alto, CA (US); Kara Krumpe, San Francisco, CA (US); Judy May Lee, San Francisco, CA (US)

(73) Assignees: Mattel, Inc., El Segundo, CA (US); Ideo, Palo Alto, CA (US)

( * ) Notice: Subject to any disclaimer, the term of this patent is extended or adjusted under 35 U.S.C. 154(b) by 0 days.

(21) Appl. No.: 11/745,546

(22) Filed: May 8, 2007

(65) Prior Publication Data

US 2008/0111413 A1 May 15, 2008

Related U.S. Application Data

(60) Provisional application No. 60/798,291, filed on May 8, 2006.

(51) Int. Cl.

| | |
|---|---|
| ***A47D 13/10*** | (2006.01) |
| ***A63G 9/02*** | (2006.01) |
| ***A63G 9/04*** | (2006.01) |
| ***A63G 9/12*** | (2006.01) |

(52) U.S. Cl. ..... 297/278; 297/273; 297/274; 297/277; 297/281; 472/118; 472/119

(58) Field of Classification Search ..... 297/278, 297/281, 282, 277, 273, 274; 472/118, 119
See application file for complete search history.

(56) References Cited

U.S. PATENT DOCUMENTS

| | | | | | |
|---|---|---|---|---|---|
| 612,991 | A | * | 10/1898 | Palmer | 297/278 |
| 614,234 | A | * | 11/1898 | Palmer | 297/278 |
| 1,369,616 | A | | 2/1921 | Bunt | |
| 1,665,553 | A | * | 4/1928 | Knappe | 297/278 |
| 1,874,345 | A | | 8/1932 | Parrott | |
| 1,906,768 | A | | 5/1933 | Romine | |
| 2,478,432 | A | | 8/1949 | Sulivan | |

(Continued)

*Primary Examiner*—Rodney B. White
(74) *Attorney, Agent, or Firm*—Edell, Shapiro & Finnan, LLC

(57) ABSTRACT

The child receiving device includes a seat, seat suspension arms for supporting the seat portion, and a support frame for supporting the seat suspension arms and the seat above a supporting surface. Two front seat suspension arms are pivotally connected at their lower ends to opposite front ends of the seat and two rear seat suspension arms are pivotally connected at their lower ends to opposite rear ends of the seat. The support frame includes a suspension guide, the upper ends of the front and rear seat suspension arms being pivotally connected to the suspension guide. The suspension guide includes a slot along which the upper ends of the front seat suspension arms may be moved toward and away from the upper ends of the rear seat suspension arms. The distance between the upper ends of the front seat suspension arms and the upper ends of the rear seat suspension arms is adjustable to convert the child receiving between a swing configuration (providing a traditional arcuate swinging motion to the child seat) and a glider configuration (providing a front-to-back, quasi-linear, translational movement to the child seat).

18 Claims, 8 Drawing Sheets

U.S. PATENT DOCUMENTS

| | | | | |
|---|---|---|---|---|
| 4,155,548 | A | 5/1979 | Smith et al. | |
| 4,190,248 | A | 2/1980 | Philippi | |
| 4,807,872 | A | 2/1989 | Spilman et al. | |
| 4,873,735 | A | 10/1989 | Fermaglich et al. | |
| 5,326,327 | A | 7/1994 | Stephens et al. | |
| 5,618,016 | A | 4/1997 | Garland et al. | |
| 5,707,294 | A * | 1/1998 | Fischer | 297/281 X |
| 5,988,670 | A | 11/1999 | Song et al. | |
| 6,887,161 | B2 * | 5/2005 | Mahlstedt et al. | 297/273 X |
| 6,932,709 | B1 * | 8/2005 | Gubitosi et al. | 472/118 |
| 2006/0186716 | A1 * | 8/2006 | Gubitosi et al. | 297/273 |
| 2007/0040431 | A1 * | 2/2007 | Bapst et al. | 297/274 |
| 2007/0129156 | A1 | 6/2007 | Greger et al. | |

* cited by examiner

RECONFIGURABLE SWING/GLIDER DEVICE

CROSS-REFERENCE TO RELATED APPLICATIONS

This application claims priority under 35 U.S.C. §119(e) to U.S. Provisional Patent Application Ser. No. 60/798,291, entitled "RECONFIGURABLE SWING/GLIDER DEVICE" and filed May 8, 2006, the disclosure of which is incorporated herein by reference in its entirety.

BACKGROUND OF THE INVENTION

The present invention relates to a movably suspended child receiving seat wherein the motion of the suspended child receiving seat can be converted between a traditional swinging motion a gliding motion. More particularly, conversion between the traditional swinging motion and the gliding motion is accomplished by relocating the upper ends of the pairs of seat suspension arms from a separated relationship to a substantially axially aligned relationship.

Young children have a need to be physically stimulated. Gentle rocking in a parent's arms is one of the most basic parental stimulations. In order to provide relief to a parent from continuous holding and rocking of a child, some child receiving devices simulate the rocking motion of a parent's arms. Child receiving devices such as gliders and swings generally include a seat portion for receiving a child, seat suspension arms having lower ends attached to the child receiving seat for suspending the seat above a supporting surface and a support frame for pivotally supporting the upper ends of the seat suspension arms and the seat above the supporting surface.

The seat portion of a child swing provides different movement characteristics than the seat of a gliders. Movement characteristic differences are evident from the connection between the seat suspension arm upper ends and the support frame. For example, child swings generally provide a pivotal (arcuate) movement to child seat. The, the child in the swing seat experiences an arcuate swinging motion (with the seat suspension arms suspending the seat from a single pivot axis). On the other hand, gliders provide a translational (front-to-back quasi-linear translation) movement to the child seat. This quasi-linear translation is produced because the upper ends of the pairs of seat suspension arms suspend the seat from two linearly spaced pivot axes, one near the front of the glider and one near the rear of the glider. Because the swings and gliders provide different seat motions they also provide different riding experiences. As a result some users prefer one over the other or prefer both, but at different times.

There is therefore a need to develop a child seat that can provide both a gliding motion experience as well as a swinging motion experience. Furthermore, there is a need to develop a child seat that can be easily reconfigured between a glider movement mode and a swing movement mode.

SUMMARY OF THE INVENTION

Generally, the present invention illustrates a reconfigurable child receiving swing/glider device including a seat portion for receiving a child, seat suspension arms pivotally connected to the seat at their lower ends for swingingly and/or glidingly suspending the seat and a support frame, the upper ends of the seat suspension arms being pivotally connected to the support frame for supporting the seat suspension arms and the seat above a supporting surface. Generally, the lower end of the two front seat suspensions arms are pivotally attached to opposite sides of the front of the seat and the lower portion of the two rear seat suspension arms are pivotally attached to opposite sides of the rear of the seat. The upper ends of the front seat suspension arms define a forward pivot axis passing through the forward pivotal connections of the support frame. Similarly, the upper ends of the rear seat suspension arms define a rear pivot axis passing through the rear pivotal connections of the support frame. The lower ends of the front and rear sear suspension arms also define lower forward and rear pivot axes respectively.

The method of converting the child seat between a swing device and glider device is accomplished by adjusting the distance between the upper forward pivot axis and the upper rear pivot axis. In other words, when the upper forward pivot axis and the upper rear pivot axis are substantially co-axial, the device behaves like a swing (providing a traditional arcuate swinging motion to the child seat). On the other hand, when there is a significant linear distance between the upper forward pivot axis and the upper rear pivot axis, the swing/glider device behaves as a glider (providing a front-to-back, quasi-linear, translational movement to the child seat). The present invention discloses a unique swing/glider device capable of adjusting the distance between the upper forward pivot axis and the upper rear pivot axis to easily convert the swing/glider device between a swing configuration and a glider configuration.

BRIEF DESCRIPTION OF THE DRAWINGS

Like reference numerals have been used to identify like elements throughout this disclosure.

DETAILED DESCRIPTION OF THE INVENTION

Figure 1:
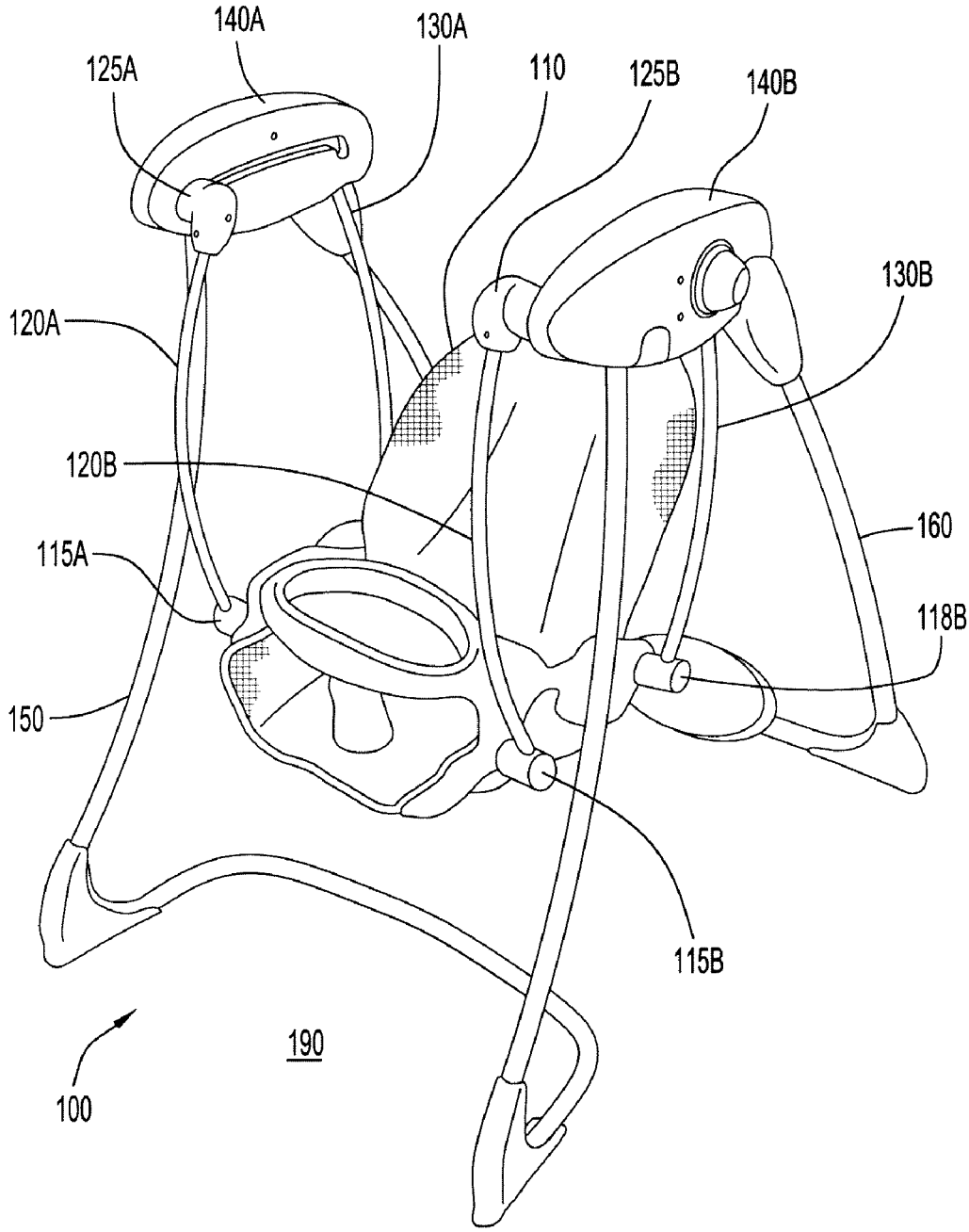
FIG. 1 illustrates a perspective view of an exemplary embodiment of the reconfigurable swing/glider device of the present invention arranged in the glider configuration.

In accordance with the present invention, a reconfigurable swing/glider device is disclosed. FIG. 1 illustrates a perspective view of the swing/glider device 100 of the present invention arranged in the glider configuration. The swing/glider 100 includes a seat portion 110 supported by a support mechanism. The seat portion 110 includes a pair of side connectors 115A and 115B located on opposite sides toward the front of the seat portion 110 and a pair of side connectors 118A, 118B located on opposite sides toward the rear of the seat portion 110. The support mechanism includes two front seat suspension arms 120A, 120B and two rear seat suspension arms 130A, 130B. The lower portion of each seat suspension arm 120A, 120B, 130A, 130B connects to its respective side connector, 115A, 115B, 118A, 118B in a pivotal relationship. The support mechanism also includes a support frame having a front base support 150 and a rear base support 160. The lower portion of the support frame contacts the supporting surface 190 while the upper portion of the support frame 150, 160 includes suspension guides 140A, 140B for pivotally connecting to and suspending the upper ends of seat suspension arms 120A, 120B, 130A, 130B.

Figure 2:
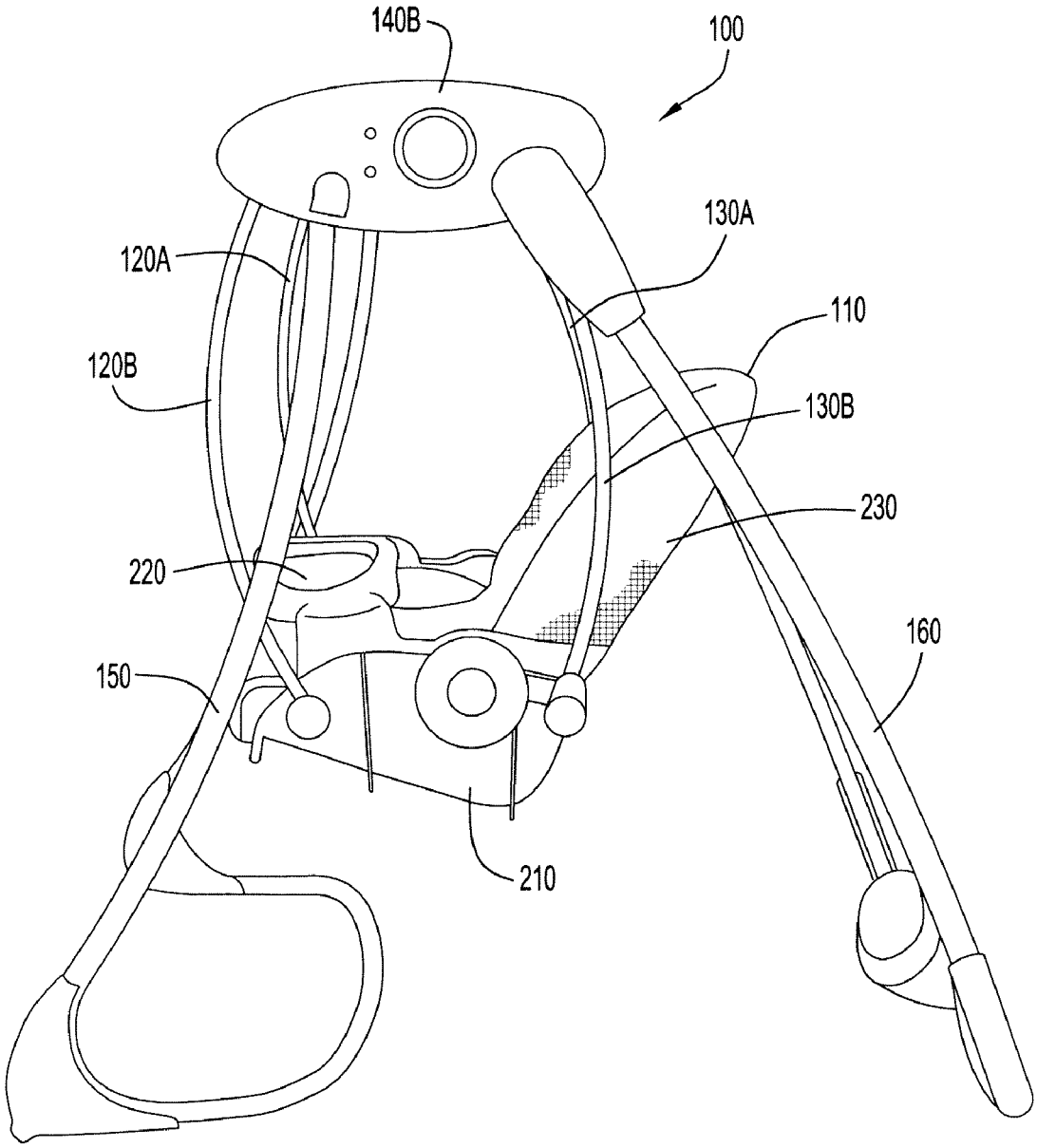
FIG. 2 illustrates a side view of the reconfigurable swing/glider device of the FIG. 1 arranged in the glider configuration.
Figure 3:
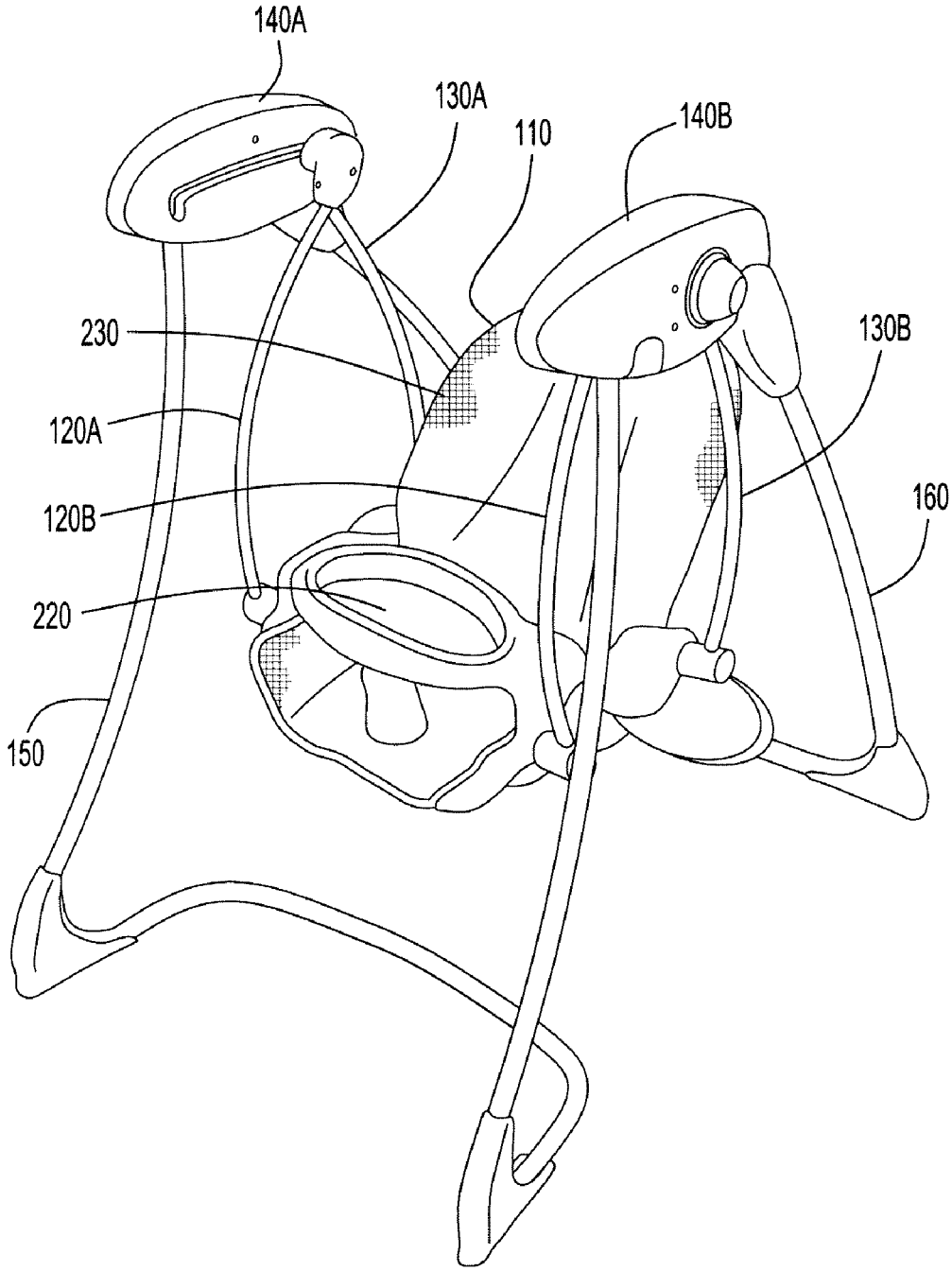
FIG. 3 illustrates a perspective view of an exemplary embodiment of the reconfigurable swing/glider device of the present invention arranged in the swing configuration.
Figure 4:
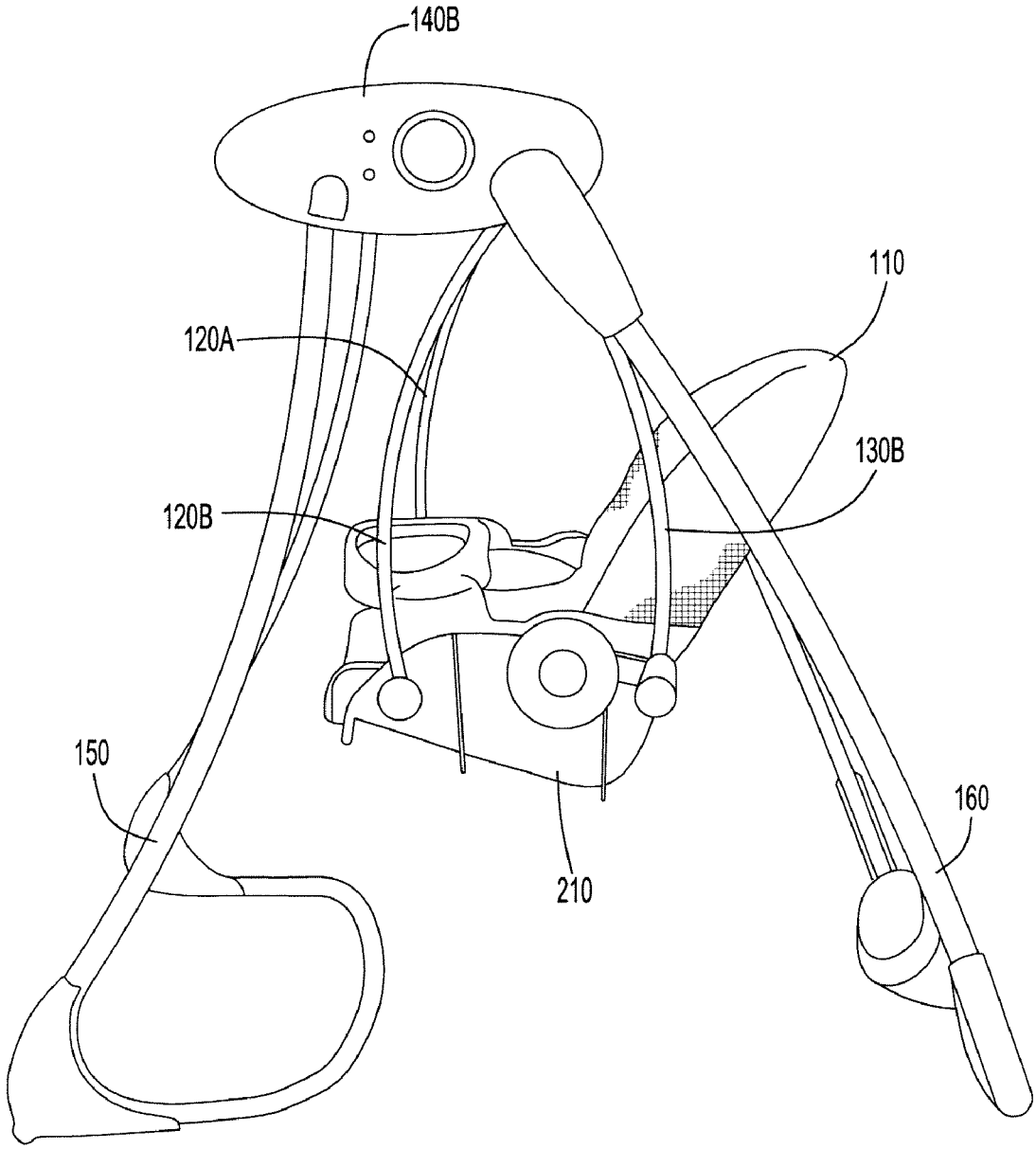
FIG. 4 illustrates a side view of the reconfigurable swing/glider device of FIG. 3 arranged in the swing configuration.

FIGS. 2-4 illustrate features similar to those illustrated in FIG. 1. Complementing the illustration of FIG. 1, FIG. 2 illustrates a side view of the reconfigurable swing/glider device 100 of the present invention arranged in the glider configuration. FIG. 2 shows the seat portion 110 which includes a seat bottom 210 supporting a seat back 230. The seat bottom 210 and seat back 230 are composed of a hard understructure with a comfortable soft goods covering. The seat portion 110 also includes a convenience tray table 220. FIG. 3 illustrates a perspective view of the reconfigurable swing/glider device 100 of the present invention reconfigured as a swing. FIG. 4 illustrates a side view of the reconfigurable swing/glider device 100 of the present invention reconfigured as a swing.

Figure 5:
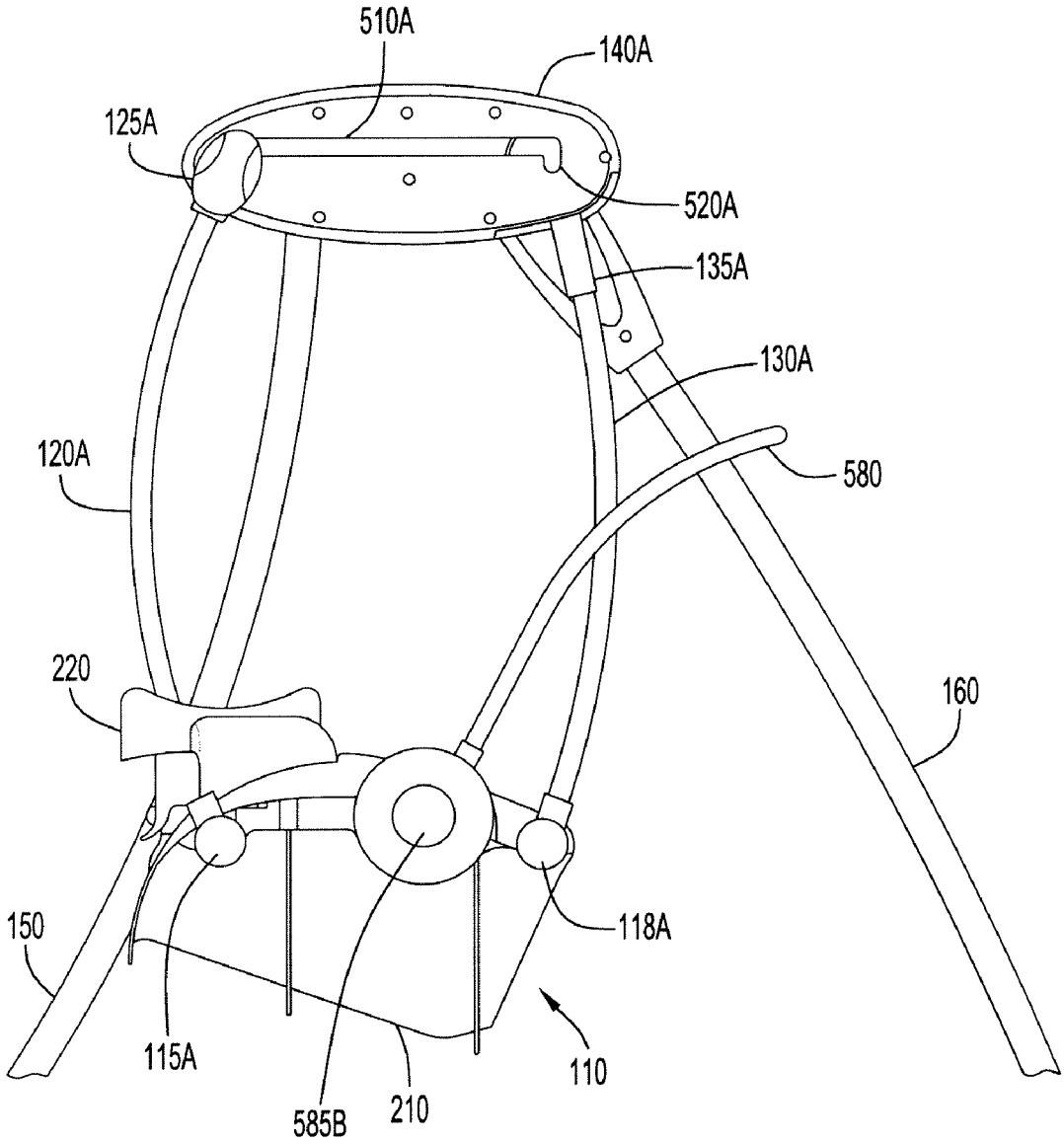
FIG. 5 illustrates a diagrammatic partial cut away side view of an exemplary embodiment of the reconfigurable swing/glider device of the present invention arranged in the glider configuration.
Figure 6:
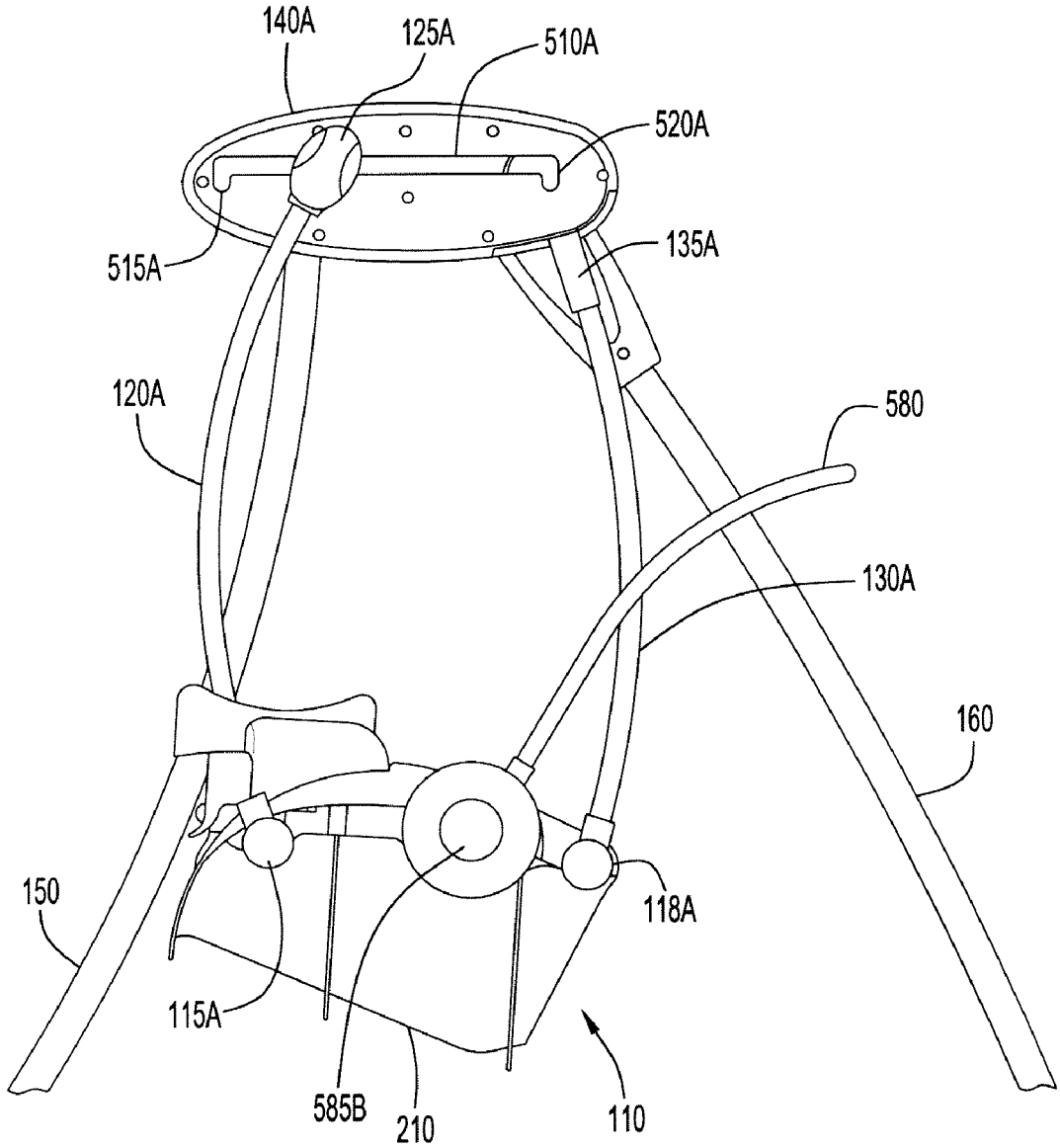
FIG. 6 illustrates a diagrammatic partial cut away side view of the reconfigurable swing/glider device of the present invention being about one-third the way converted from the glider configuration into the swing configuration.
Figure 7:
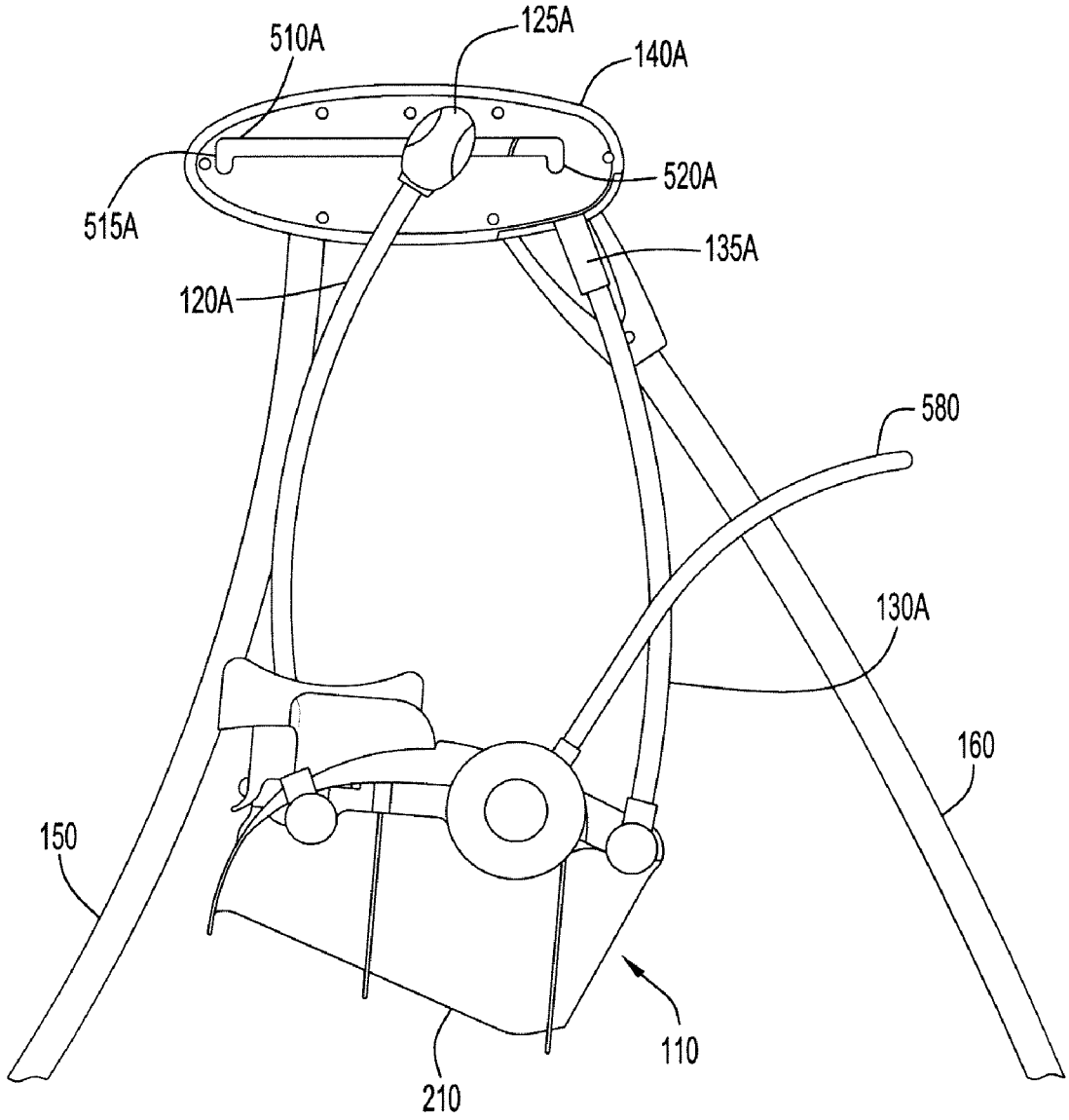
FIG. 7 illustrates a diagrammatic partial cut away side view of the reconfigurable swing/glider device of the present invention being about two-thirds of the way converted from the glider configuration into the swing configuration.
Figure 8:
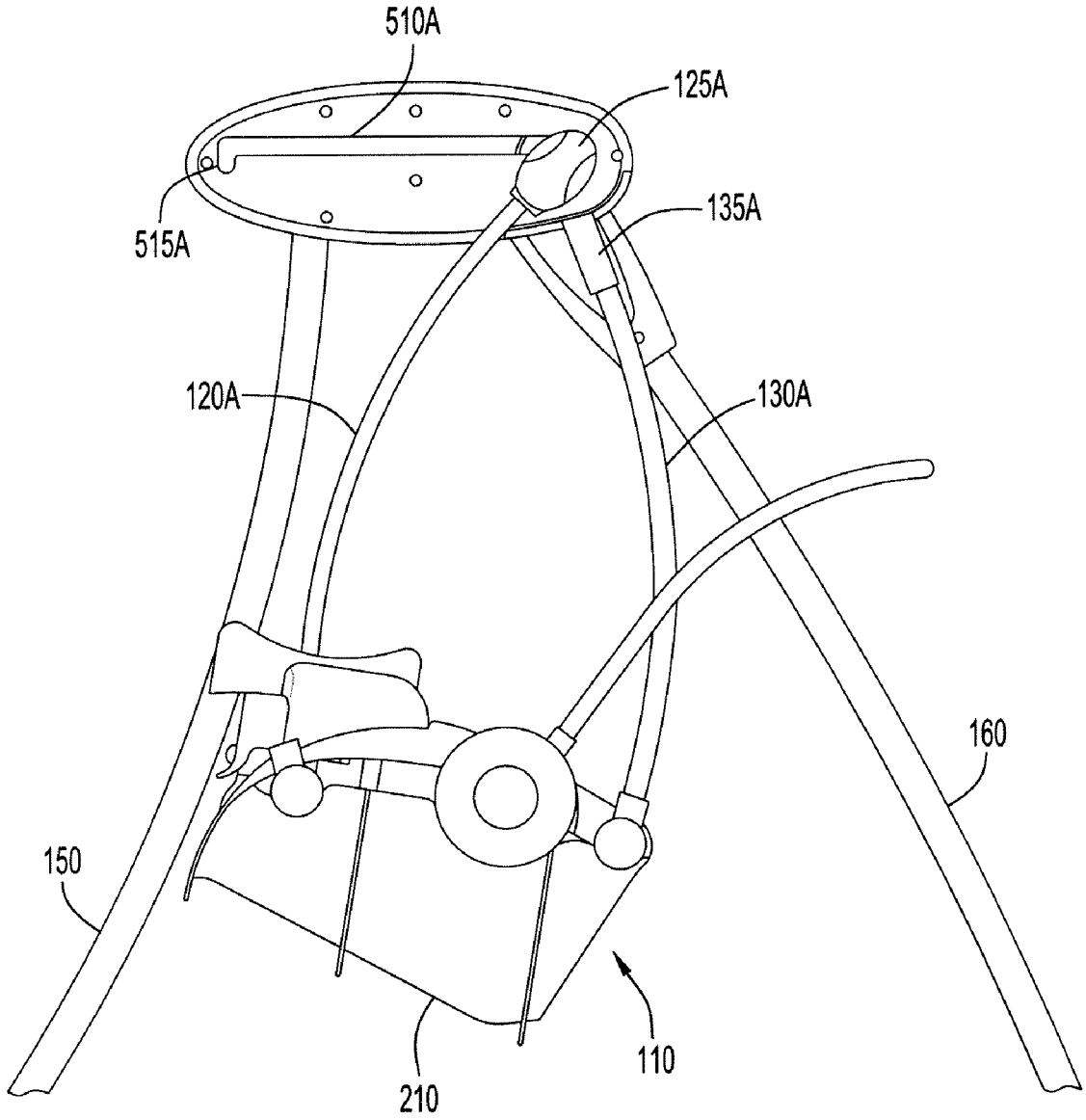
FIG. 8 illustrates a diagrammatic partial cut away side view of the reconfigurable swing/glider device of the present invention finally arranged in the swing configuration.

FIGS. 5-8 show diagrammatic partial cutaway views of the swing/glider device 100 of the present invention being sequentially converted from a glider in FIG. 5 to a swing in FIG. 8. Note that in FIGS. 5-8, the right side of the support frame (150, 160) and the right suspension guide 140B are not shown for the purpose of more clearly illustrating the reconfiguration of the device 100 between the glider and swing modes. Specifically, FIG. 5 illustrates a diagrammatic partial cut away side view of the swing/glider device 100 arranged in the glider configuration. Following sequentially, FIG. 6 illustrates a diagrammatic partial cut away side view of the swing/glider device 100 being about one-third the way converted from glider configuration to the swing configuration. Advancing the sequence, FIG. 7 illustrates a diagrammatic partial cut away side view of the swing/glider device 100 being about two-thirds the way converted from the glider configuration to the swing configuration. Finally, FIG. 8 illustrates a diagrammatic partial cut away side view of the swing/glider device 100 finally arranged in the swing configuration.

FIG. 5 shows how the upper portion of each seat suspension arm 120A, 120B, 130A, 130B (only arms 120A and 130A are shown in FIGS. 5-8) is connected to a respective suspension guide 140A, 140B in a pivotal relationship. The upper portion of each of the front suspension arms 120A, 120B has a respective upper front pivot connector 125A, 125B (also see FIG. 1). Likewise the upper portion of each rear seat suspension arm 130A, 130B has a respective upper rear pivot connector 135A, 135B engaged with the suspension guides 140A, 140B. The axes of the upper front pivot connectors 125A, 125B are collinear and from an upper front pivot axis. Similarly, the axes of the upper rear pivot connectors 135A, 135B are collinear and form an upper rear pivot axis.

Regarding the forward seat suspension arms 120A, 120B, the suspension guides 140A, 140B include a slots 510A, 510B within which the upper front pivot connectors 125A, 125B are guidable toward and away from the respective upper rear pivot connectors 135A, 135B of the rear seat suspension arms 130A, 130B. The slots 510A, 510B each further include forward lock notches 515A, 515B and rear lock notches 520A, 520B.

To arrange the swing/glider device 100 of the present invention into the glider mode, the upper front pivot connectors 125A, 125B mare moveable within the slots 510A, 510B until they become locked into forward lock notches 515A, 515B in a spaced relationship. When the upper front pivot connectors 125A, 125B are locked in the forward lock notches 515A, 515B the swing/glider device 100 is configured in the glider configuration.

The swing/glider device 100 of the present invention can also be rearranged into the swing configuration by adjusting the front seat suspension arms 120A, 120B. To reconfigure the swing/glider into swing mode, the upper front pivot connectors 125A, 125B are translated within slots 510A, 510B toward the rear of the slots to rear lock notches 520A, 520B. When the upper front pivot connectors 125A, 125B become locked into the rear lock notches 520A, 520B, the swing/glider 100 is in swing mode. In other words, when the upper front pivot connectors 125A, 125B are locked into the rear lock notches 520A, 520B, the upper front pivot axis is substantially coaxial with the upper rear pivot axis and the swing/glider device is in a swing mode (providing a traditional arcuate swinging motion to the child seat).

Reconfiguration from swing mode to glider mode or vise versa, therefore, simply requires a user (e.g., in the case of swing to glider) to lift the upper front pivot connectors 125A, 125B from the rear lock notches 520A, 520B into the slots 510A, 510B and then slide them forward down into the front lock notches 515A, 515B. When the upper front pivot connectors 125A, 125B are locked into the front lock notches 515A, 515B, the swing/glider device 100 is configured as a four bar linkage that behaves like a glider (providing a front-to-back, quasi-linear, translational movement to the child seat).

Regarding the rear seat suspension arms 130A, 130B, the suspension guides 140A, 140B permanently engage the upper rear pivot connectors 135A, 135B to prevent them form translating, while allowing them to pivot about a fixed horizontal axis. In an embodiment of the present invention wherein the movement of the device 100 is motorized, force (torque) from the motor (not shown) is applied to the upper rear pivot connectors 135A, 135B to cause back-and- forth motion of the seat portion 110 and suspended arms 120A, 120B, 130A, 130B.

FIG. 5 also shows the hard understructure of the seat back 210 in the form of a backrest bar 580. The backrest bar 580 is connected to the seat bottom 210 by an adjustable pivot connection 585B. The back rest bar 580 may be tilted backward to allow the occupant of the seat portion to swing or glide in the seat portion 110 in a reclined manner.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

Moreover, one of ordinary skill in the art may find it obvious to make modifications to the exemplary embodiment illustrated in the foregoing disclosure while remaining within the scope of the basic inventive concept. For example, the invention can be composed of as few as one front and one rear suspension arm or can have two or more front and two or more rear suspension arms.

We claim:

1. A reconfigurable child receiving device comprising:

a seat having a front and a rear;

at least one front suspension arm, said at least one front suspension arm having a front arm upper end and a front arm lower end, said at least one front suspension arm pivotally connected to the front of said seat at said front arm lower end;

at least one rear suspension arm, said at least one rear suspension arm having a rear arm upper end and a rear arm lower end, said at least one rear suspension arm pivotally connected to the rear of said seat at said rear arm lower end; and a support frame for supporting said seat and said at least one front and rear suspension arms above a supporting surface, said support frame including a suspension member, said at least one front suspension arm being pivotally connected to said suspension member at said front arm upper end along a first pivot axis and said at least one rear suspension arm being pivotally connected to said suspension member at said rear arm upper end along a second pivot axis, said suspension member including a linear slot therein configured to receive said at least one front suspension arm front arm upper end, wherein at least one of said first pivot axis and said second pivot axis is moveable between a first, swing mode wherein said first pivot axis is substantially coaxially aligned with said second pivot axis to provide an arcuate swinging motion to the seat, and a second, glider mode wherein said first pivot axis is spaced from said second pivot axis to provide a front-to-back, quasi-linear, translational movement to the seat.

2. The reconfigurable child receiving device of claim 1, wherein said front arm upper end of said at least one front suspension arm translates along said linear slot as said first pivot axis is separated from and substantially coaxially aligned with said second pivot axis.

3. The reconfigurable child receiving device of claim 1, wherein said front arm upper end of said at least one front suspension arm translates within said linear slot during reconfiguration between said swing mode and said glider mode.

4. The reconfigurable child receiving device of claim 1, wherein said linear slot includes first and second lock notches along a length of said linear slot.

5. The reconfigurable child receiving device of claim 4, wherein said first lock notch is located proximate a first end of said linear slot and said second lock notch is located proximate a second end of said linear slot.

6. The reconfigurable child receiving device of claim 5, wherein said first and second lock notches comprise linear notches which are transverse with respect to said linear slot.

7. The reconfigurable child receiving device of claim 6, wherein said front arm upper end is received in said first lock notch in said glider mode and said front arm upper end is received in said second lock notch in said swing mode.

8. The reconfigurable child receiving device of claim 4, wherein said front arm upper end of said at least one front suspension arm is received in said first lock notch in said glider mode.

9. The reconfigurable child receiving device of claim 8, wherein said front arm upper end of said at least one front suspension arm is received in said second lock notch in said swing mode.

10. A reconfigurable child receiving device comprising:

a seat having a front and a rear;

a support frame positioned above said seat and configured to support said seat above a supporting surface;

at least one front suspension arm pivotally connecting said front of said seat to said support frame, said support frame including a suspension member having a linear slot therein configured to receive said at least one front suspension arm;

at least one rear suspension arm pivotally connecting said rear of said seat to said support frame; and wherein said at least one front suspension arm is pivotally connected to said support frame along a first pivot axis and said at least one rear suspension arm is pivotally connected to said support frame along a second pivot axis, and wherein at least one of said first pivot axis and said second pivot axis is moveable between a swing mode in which said first pivot axis is substantially coaxially aligned with said second pivot axis to provide an arcuate swinging motion to said seat, and a glider mode in which said first pivot axis is spaced apart from said second pivot axis to provide a front-to-back, quasi-linear, translational movement to said seat.

11. The reconfigurable child receiving device of claim 10, wherein said at least one front suspension arm translates within said linear slot during reconfiguration between said swing mode and said glider mode.

12. The reconfigurable child receiving device of claim 11, wherein said linear slot includes first and second lock notches along a length of said linear slot, said first lock notch being located proximate a first end of said linear slot and said second lock notch being located proximate a second end of said linear slot.

13. The reconfigurable child receiving device of claim 12, wherein said at least one front suspension arm is received in said first lock notch in said glider mode.

14. The reconfigurable child receiving device of claim 12, wherein said at least one front suspension arm is received in said second lock notch in said swing mode.

15. A method of reconfiguring child receiving device between a swing configuration and a glider configuration comprising the steps of:

providing a seat having a front and a rear;

providing at least one front suspension arm, said at least one front suspension arm having a front arm upper end and a front arm lower end, said at least one front suspension arm pivotally connected to the front of said seat at said front arm lower end;

providing at least one rear suspension arm, said at least one rear suspension arm having a rear arm upper end and a rear arm lower end, said at least one rear suspension arm pivotally connected to the rear of said seat at said rear arm lower end;

providing a support frame for supporting said seat and said at least one front and rear suspension arms above a supporting surface, said support frame including a suspension member, said at least one front suspension arm being pivotally connected to said suspension member along a first pivot axis and said at least one rear suspension arm being pivotally connected to said suspension member along a second pivot axis, said suspension member including a linear slot therein configured to receive said at least one front suspension arm front arm upper end; and reconfiguring said child receiving device between the swing mode and the glider mode by moving at least one of said first pivot axis and said second pivot axis from a position in which said first pivot axis and said second pivot axis are substantially coaxially aligned with one another providing an arcuate swinging motion to said seat to a second position wherein said first pivot axis is separated from said second pivot axis to provide a front-to-back, quasi-linear, translational movement to said seat.

16. The method of claim 15, wherein said step of reconfiguring said child receiving device between the swing mode and the glider mode comprises translating said front arm upper end of said at least one front suspension arm along said linear slot to separate said first pivot axis from being substantially coaxially aligned with said second pivot axis.

17. The method of claim 16, wherein said linear slot includes first and second lock notches along a length of said linear slot, said first lock notch being transverse with respect to said linear slot and being located proximate a first end of said linear slot and said second lock notch being transverse with respect to said linear slot and being located proximate a second end of said linear slot, wherein said step of reconfiguring said child receiving device between the swing mode and the glider mode further comprises removing said at least one front suspension arm front arm upper end from said second lock notch and sliding said at least one front suspension arm front arm upper end along said linear slot towards said first lock notch.

18. The method of claim 17, wherein said step of reconfiguring said child receiving device between the swing mode and the glider mode further comprises moving said at least one front suspension arm front arm upper end into said first lock notch.

* * * * *